United States Patent [19]

des Snead

[11] Patent Number: 4,671,198

[45] Date of Patent: Jun. 9, 1987

[54] MULTI-HULL, ANTI-CAPSIZING SAILBOAT

[76] Inventor: Edwin des Snead, P.O. Box 1000, Georgetown, Tex. 78626

[21] Appl. No.: 695,729

[22] Filed: Jan. 28, 1985

[51] Int. Cl.[4] ..... B63B 35/00; B63H 9/10

[52] U.S. Cl. ..... 114/39; 114/61; 114/106; 114/107

[58] Field of Search ..... 114/39, 61, 106, 107, 114/345, 356; 403/170

[56] References Cited

U.S. PATENT DOCUMENTS

| | | | |
|---|---|---|---|
| 2,197,654 | 4/1940 | Beaudry | 114/107 |
| 4,228,750 | 10/1980 | Smith et al. | 114/39 |
| 4,278,217 | 7/1981 | Blackwell | 242/217 |
| 4,294,184 | 10/1981 | Heinrich | 114/61 |
| 4,316,424 | 2/1982 | McKenna | 114/39 |
| 4,326,475 | 4/1982 | Berté | 114/39 |
| 4,524,709 | 6/1985 | McKenna | 114/39.1 |

*Primary Examiner*—Sherman D. Basinger
*Attorney, Agent, or Firm*—Peter J. Murphy

[57] ABSTRACT

A three hulled sailboat consists of a tripod frame having three generally horizontal spars which define support points at their distal ends. During the sailing of the boat, one support point is always toward the windward, and the other two support points are leeward. A generally vertical mast supported on the frame has a masthead spaced equidistantly from the two lee support points and generally above the windward support point. Three buoyant hulls are coupled to the respective support points, the hulls being elongated with a high length-to-beam ratio, and being symmetrical about a transverse vertical plane for movement through the water in either direction. The hulls are coupled for independent rotation and steering relative to the frame and also for independent pitching relative to the frame about transverse central axes. Independent steering is provided for each of the three hulls relative to the frame. The boat sail is mounted generally in a plane defined by the two lee support points and the masthead; and the lower end of the sail is secured to a roller boom rotatably supported generally between the two lee support points. The sail is reeved by being taken up on the roller boom, and is raised by a halyard reeved over the masthead; and the sail is readily raised and reefed by the pilot so that any desired area of sail may be presented to the wind.

23 Claims, 11 Drawing Figures

MULTI-HULL, ANTI-CAPSIZING SAILBOAT

BACKGROUND AND SUMMARY OF THE INVENTION

This invention relates to a sailboat having a multiple hull structure; and more particularly to such sailboat which is light in weight and which can safely carry a large sail in relation to its weight.

For many years boat designers have been convinced that a boat's speed was limited by its waterline length. The accepted formula stated: the hull speed in knots is 1.4 times the square root of the waterline length in feet. At this hull speed, the bow wave gets in phase with the stern wave, with the result that the boat is constantly trying to climb over a mountain of water of its own making.

If there is sufficient thrust available, a boat can actually climb over this mountain of water; and then, in the planing mode, it can go many times faster than the hull speed. In the planing mode, the weight of the boat is supported by dynamic forces rather than buoyant forces. However, because the drag increases with the square of the speed, planing generally requires for more power than is available on sailboats.

The reversal of the slope of the drag-versus-speed curve is called the "hump", and has been verified many times by the present inventor and others by tow testing of various hulls. The effect is most pronounced with hulls having a length only two or three times their width; and it almost disappears entirely when the hull lengths are six or seven times their width. A boat with a length-to-beam ratio of seven or more displays a smooth drag-versus-speed curve, with the drag being proportional to the square of the speed. The drag of such a boat hull is much less than the drag of a shorter hull having equal displacement. Such a hull has very little roll stability to keep the boat erect against the force of the wind, and hence the sail area which may be carried by such a boat is minimized.

One obvious answer to improving sail carrying ability is multiple-hull boats. Multiple-hull boats are able to carry more sail area per unit of weight than a single-hull boat. The best multi-hull boats are about twice as fast as single-hull boats of equivalent displacement in the same wind.

Edmond Bruce, an early contributor to sailboat racing literature, has suggested a measure of quality for sailboats called the "Bruce Number". It is the square root of the sail area in square feet, divided by the cube root of the displacement in pounds. Most single-hull boats operate with Bruce numbers in the range of 0.8 to 1.0, while the fastest multiple-hull boats operate in the range of 1.6 to 1.8.

Multiple-hull boats (catamarans and trimarans) suffer from major disadvantages which render them unseaworthy in the minds of conventional yachtsmen. Most importantly, when they capsize they will not right themselves. Secondly, the hulls are rigidly connected and this results in structurally destructive forces on the connecting members when the hulls, moving through rough water, encounter slightly different wave patterns. When the connecting beams are made stronger and larger, they produce an effective wing or airfoil which can be caught by the wind when the boat is heeling to contribute to capsizing the boat.

An object of this invention is to provide a fast lightweight multiple-hull sailboat having the ability to carry a sail of larger area than known multiple-hull sailboats.

Another object of this invention is to provide a sailboat designed so that it will not capsize.

A further object of this invention is to provide a sailboat utilizing multiple-hulls having a high length-to-beam ratio.

Still another object of this invention is to provide a sailboat capable of carrying more sail area per unit weight than known multiple-hull sailboats.

Still another object of this invention is to provide a multiple-hull sailboat capable of carrying more sail area per weight of displacement than known multiple-hull sailboats.

Another object of this invention is to provide a sailboat which will operate with a Bruce Number in excess of 2.0.

A further object of this invention is to provide a multiple-hull sailboat wherein the sail is always inclined upwardly to the windward, to eliminate any downward component of wind force acting on the boat, and wherein the boat hulls operate continuously in contact with the water surface.

Still another object of this invention is to provide a sailboat wherein the boat hulls are mounted relative to the boat frame to pitch independently and thereby accomodate different wave patterns.

A still further object of this invention is to provide a sailboat wherein the presented sail area may be readily changed from 0 to 100 percent.

Another object of this invention is to provide a very light weight sailboat which can safely carry a very large area sail and be operated by a single pilot.

A further object of this invention is to provide a sailboat wherein the frame and mast consist of spars joined by a common coupler enabling different angular relationships and enabling folding for transport or storage.

These objects are accomplished in a sailboat having the following structural features. A rigid frame defines three triangularly spaced support points for support by three respective buoyant hulls, including a windward support point and two lee support points. Three independent buoyant hulls for supporting the frame on the water include a windward hull coupled to the windward support point, and two lee hulls coupled to the two lee support points. Each of the buoyant hulls is elongated and configured to move through the water in either of two opposite directions. Coupling means for each hull includes a vertical pivot axis to enable independent steering of each hull relative to the frame. A mast supported on the frame has a masthead disposed equidistant from the lee support points and toward the windward support point. A sail is supported on said frame generally in a plane defined by the lee support points and the masthead, whereby the sail is inclined upwardly from the lee hulls toward the windward hull.

The novel features and the advantages of the invention, as well as additional objects thereof, will be understood more fully from the following description when read in connection with the accompanying drawings.

DESCRIPTION OF THE PREFERRED EMBODIMENT

The sailboat frame consists of three legs or spars which are connected together at the center and extend radially outward, with the central juncture of the three spars being elevated somewhat relative to the plane defined by the distal ends of the spars. The distal ends of the spars defined three support points at which the frame is supported by three respective independent buoyant bodies or hulls. A generally vertical mast extends upward from the frame center point, and is inclined from the vertical as will be described.

Figure 3:
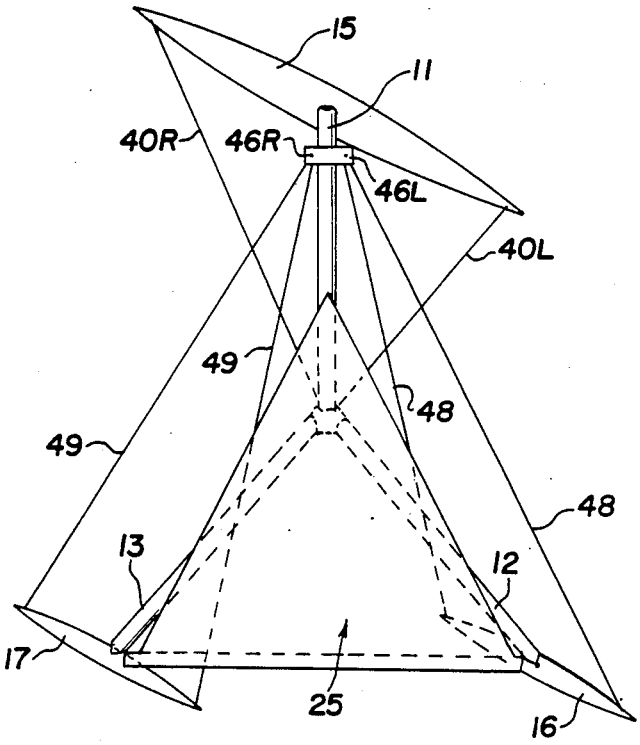
FIG. 3 is a top view of the sailboat of FIG. 1.

Referring now more particularly to the drawings, the three spars of the boat frame 10 include a windward spar 11, a left lee spar 12 which extends to the left of the windward spar as viewed from its distal end, and a right lee spar 13. These spars are of generally equal length and are connected together at the center. As best seen in FIG. 3, by way of example, the left and right lee spars are spaced angularly from the windward spar about 140 degrees; and the angle between the left and right lee spars is then about 80 degrees.

A windward buoyant body or hull 15 is coupled to a windward support point at the distal end of the windward spar 11; and this windward hull, in the illustrative embodiment, carries the boat pilot. Lee buoyant bodies or hulls, referred to as the left lee hull 16 and the right lee hull 17 are coupled respectively to left and right lee support points of the left and right lee spars 12 and 13 respectively. These lee hulls are smaller than the windward hull 15, in the illustrative embodiment; but the hulls could all be the same size. The coupling of the hulls to the frame includes a vertical rotational axis, to allow for independent steering of the three hulls as will be described.

Figure 2:
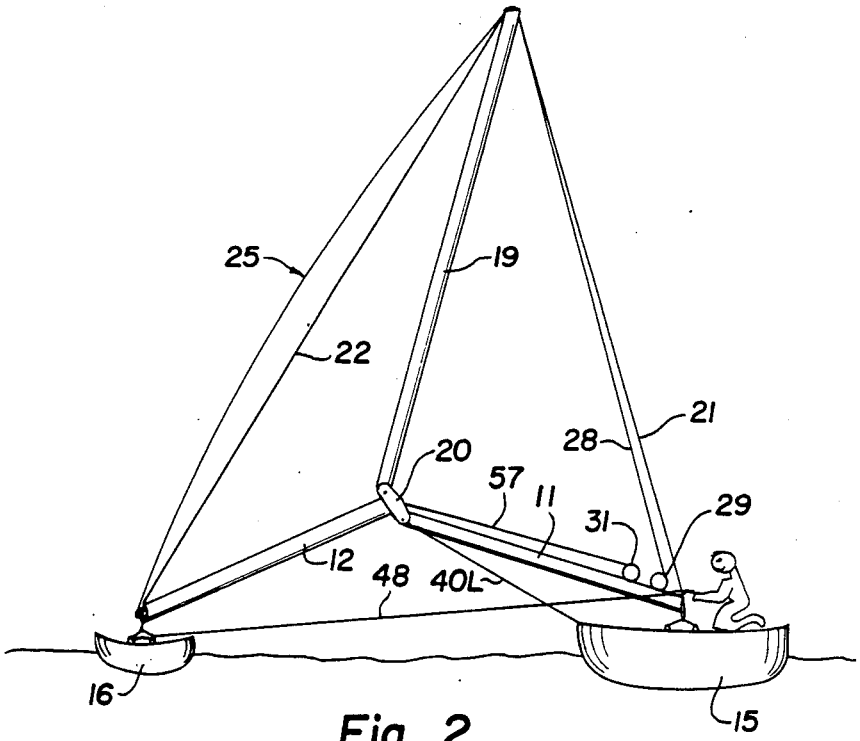
FIG. 2 is an elevation view of the sailboat of FIG. 1, with the lee hulls aligned.

The mast 19 is shown as a single spar, the base of which is connected to the frame at its center point and may be disposed vertically. In the illustrative embodiment, the mast is disposed in the vertical plane which includes the windward spar 11, and is inclined toward the windward hull so that the masthead is much closer to the windward hull than it is to the lee hulls. This inclination of the mast is best seen in FIG. 2 which is an elevation view of the sailboat with the left and right lee hulls in tandem.

Figure 6:
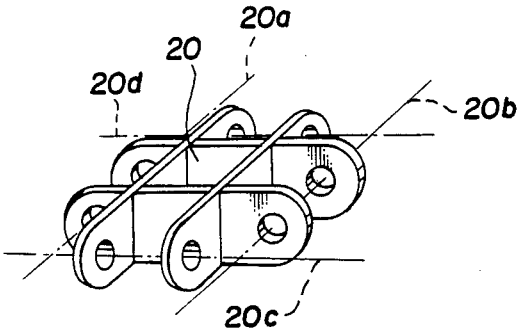
FIG. 6 is a perspective detail view of the frame coupler illustrated in FIG. 1.
Figure 6A:
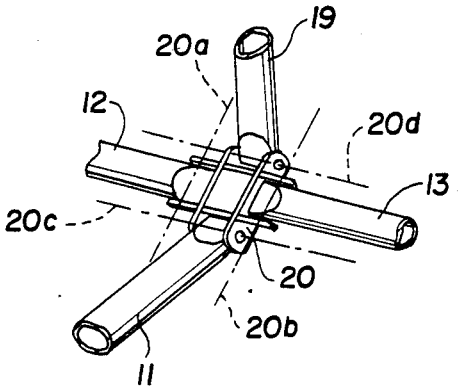
FIG. 6A is a fragmentary detail view of the frame coupler and frame.

The three spars 11, 12 and 13 and the mast 19 are joined together by means of a coupler 20 illustrated in FIG. 6 with the assembly being illustrated in detail in FIG. 6A. The coupler 20 is a structural member defining four pivot axes for the above mentioned respective frame spars and mast, which pivot axes are disposed in a common plane. One pair of parallel axes 20*a* and 20*b*, indicated in FIG. 6, define pivot axes for the left and right lee spars 12 and 13 respectively. Another pair of parallel axes 20*c* and 20*d*, indicated in FIG. 6, is perpendicular to the axes 20*a* and 20*b*. The axis 20*c* is the pivot axis for the windward spar 11; and the axis 20*d* is the pivot axis for the mast 19. The utilization of this coupler 20 provides a number of advantages which will be described subsequently.

In the working relationship of the frame spars, illustrated in the drawings, the distal ends of the three spars are disposed in a generally horizontal plane, and the juncture of the spars at the coupler 20 is elevated relative to that horizontal plane. The amount of that elevation, that is the vertical distance between that horizontal plane and the the coupler 20, is determined by the distance established between the distal ends of the three spars. The distance between the distal ends of the two lee spars is fixed by the roller boom for the sail, to be described. This distance between the distal ends of the windward spar and respective lee spars if fixed by horizontal stays 14 connected between those spars. The position of the mast 19 relative to the frame is determined by a back stay 21 connected between the windward spar and the masthead, a left forestay 22 connected between the left lee spar and the masthead, and a right forestay 23 connected between the right lee spar and the masthead.

Each of the hulls 15, 16 and 17 has a high length-to-beam ratio, a ratio of at least 7; and the hulls are designed to travel efficiently through the water in opposite directions. For this purpose, the hulls are symmetrical about a central transverse plane. In addition to being coupled for independent steering relative to the frame support points, each of the hulls is coupled for independent pitching about a transverse pitch axis which is disposed in that central transverse plane. Each of the hulls then is allowed to pitch independently relative to the frame and follow the water surface. This pitch freedom of the hulls allows the frame to be built much lighter than it would have to be if it had to resist the torsion forces generated by wave action.

With the above described mounting of the hulls, they are prevented from rolling, and are provided with deep V bottom profiles to present minimum resistance to longitudinal movement through the water in both directions and maximum resistance to lateral movement of the hulls. Desirably the hulls, or at least a portion of them, are fabricated from thin sheet metal without internal bulkheads, and are fabricated as closed sealed structures so that the external hull surfaces may be maintained in gentle compound curves by the internal air pressure.

The sail 25 for the sailboat is supported generally in a plane defined by the left and right lee support points and the tip of the mast or masthead, these points defining an isosceles triangle. The sail 25 also has the shape of an isosceles triangle defined by a base edge, and the two equal side edges. The base edge of the sail is secured to and supported by a roller boom 26 which is rotatably supported between the left and right lee spars, adjacent to the support points thereof; and the sail is reefed by rotating the roller boom to roll the sail onto the boom. To minimize billowing of the sail, a plurality of vertically spaced, horizontal battens 27 are secured in the sail structure, these battens of course being parallel to the sail base and to the roller boom to allow for the reefing of the sail onto the roller boom. The top of the sail is supported and raised by means of a halyard 28 which is reeved over a pulley at the masthead and is taken upon a winch 29. The halyard winch is mounted on the windward spar 11 adjacent to the windward hull 15 so as to be accessible to the sailboat pilot. A reefing winch 31 is also mounted on the windward spar adjacent to the windward hull for reefing the sail as will be described. With this mounting of the sail, any desired sail area may be presented at any time; and the amount of presented sail area may be readily changed by the boat pilot.

As best seen in FIG. 3, the sail is tilted or inclined substantially from the left and right lee hulls 16 and 17 toward the windward hull 15; and in the operation of the sailboat the windward hull is always to the windward so that the vertical component of the wind force is acting to lift the entire sailboat. The effect of this is to reduce the displacement of the sailboat hulls and correspondingly to reduce the drag as the wind force increases. Also, the overall sail force resultant is directed upward along a line passing through (or below) the windward hull 25, so that there is almost no tendency of the boat to capsize.

Figure 4:
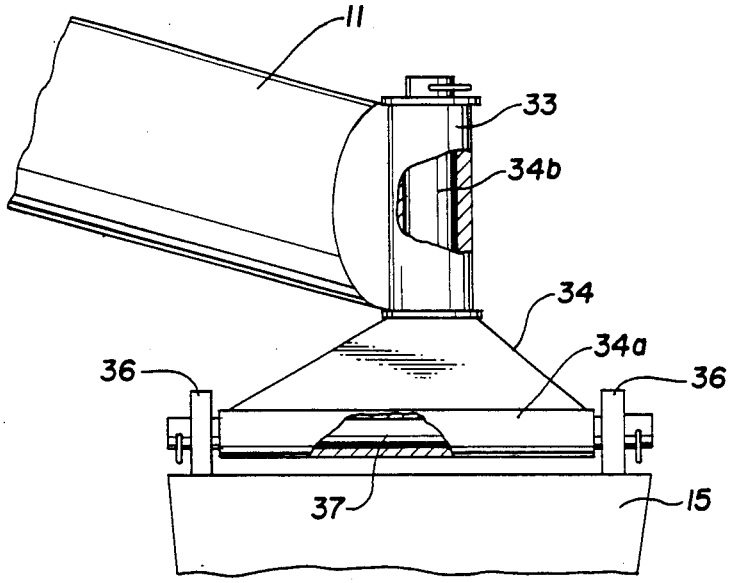
FIG. 4 is a fragmentary detail view illustrating the coupling of the frame to a hull.

FIG. 4 is a detail view illustrating the manner in which each of the three hulls are mounted on the boat frame, and is a fragmentary detail view of the windward hull 15 and the associated frame structure. As seen in FIG. 4, the distal end of the windward spar 11 is provided with a vertical bearing sleeve 33 which defines the windward support point of the frame 10. This bearing sleeve is aligned vertically relative to the plane of the water surface, for the normal supported position of the boat frame 10. A yoke 34 includes an integral horizontal bearing sleeve 34A and a vertical journal shaft 34B, with the sleeve 34A and the shaft 34B being oriented perpendicular to each other. The journal shaft 34B is received within the frame bearing sleeve 33; and these members then define the vertical steering axis for the hull 15 relative to the boat frame.

The windward hull 15 is viewed along its longitudinal axis in FIG. 4; and this hull is provided with brackets 36 which are located on opposite sides of the hull and at the midpoint of the hull length. These brackets support a journal pin 37 which passes through the yoke bearing sleeve 34A; and this bearing sleeve and journal pin define the pitch axis of the hull relative to the boat frame.

Each of the hulls 15, 16 and 17 is coupled to the frame 10 in this manner; and the bearing sleeves 33 for the three spars define the respective support points of those frame spars. It will be seen then that each of the hulls is mounted for independent steering relative to the boat frame.

The windward hull 15 is steered or oriented relative to the boat frame by steering lines 40L and 40R. These steering lines are connected to the boat frame near the junction point of the frame spars, pass through respective pulleys 41L and 41R mounted at the ends of the hull 15, and are secured by means of respective cleats 42L and 42R. The position of the windward hull will be changed through the use of these steering lines for different attitudes of the boat relative to the wind; however, the position of this hull will remain fixed relative to the frame once a particular boat attitude has been established.

Figure 1:
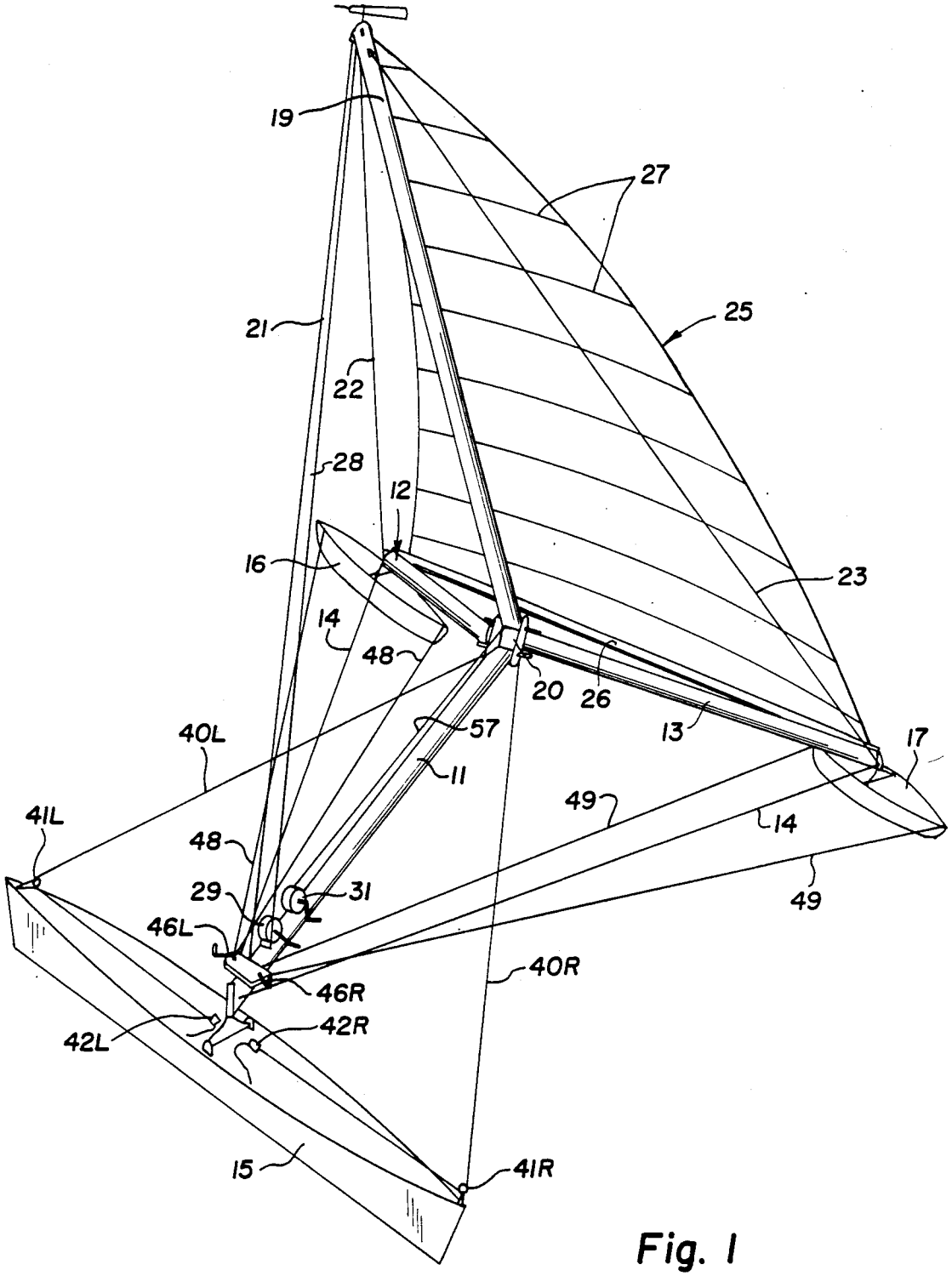
FIG. 1 is a perspective view of a sailboat according to the invention.
Figure 7:
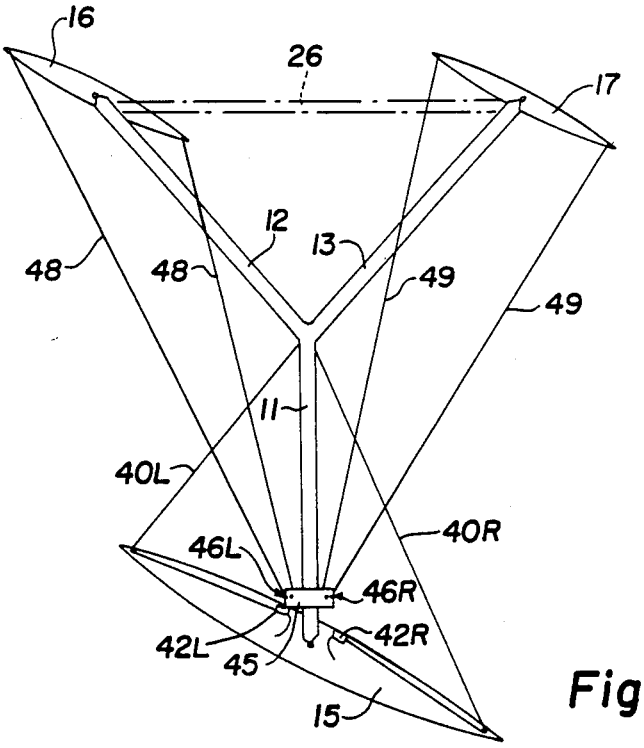
FIG. 7 is a diagrammatic view illustrating the steering of the sailboat hulls.
Figure 8:
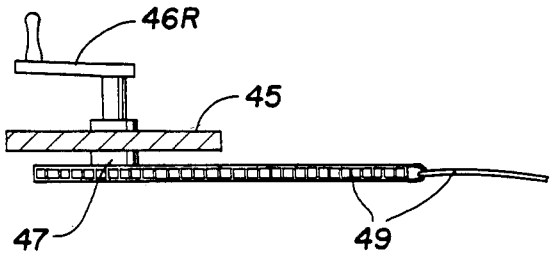
FIG. 8 is a detail view of the steering control of the lee hulls.

The two lee hulls 16 and 17 are steered independently of each other; and the steering control for these hulls is illustrated in FIGS. 1, 7 and 8. As best seen in FIG. 1, a table 45 is mounted on the windward spar 11 adjacent to its distal end, for supporting steering cranks 46L and 46R for controlling the steering, respectively of the left lee hull 16 and the right lee hull 17. As best seen in FIG. 8, each crank is supported for rotation in the table 45, and the shaft of the crank extends through the table and has sprocket 47 nonrotatably fixed to the shaft beneath the table. As best seen in FIG. 7, a steering line 48 for the left lee hull is attached to the respective ends of the hull and extends around the sprocket 47 of the steering crank 46L. This steering line consists preferably of a sprocket chain portion intermediate its ends which coacts with the sprocket 47, and any other suitable form of line or cable extending between the sprocket chain and the hull. Similarly, a steering line 49 is connected to the ends of the right lee hull and extends around the sprocket 47 associated with the steering crank 46R. Preferably, the steering cranks 46L and 46R will be provided with some form of brake or locking mechanism so that the selected steering orientation of one of these hulls relative to the frame may be fixed and maintained. It will be seen that the swing of the several hulls relative to the frame is limited, as controlled by these steering mechanisms.

The manner of manuevering or controlling the boat will be described subsequently. It will be mentioned here that once the attitude of the boat relative to the wind has been established, the three hulls will be aligned parallel with each other. The boat pilot may then use either the leading lee hull or the trailing lee hull as a boat rudder for maintaining direction and for making minor directional adjustments.

Figure 5:
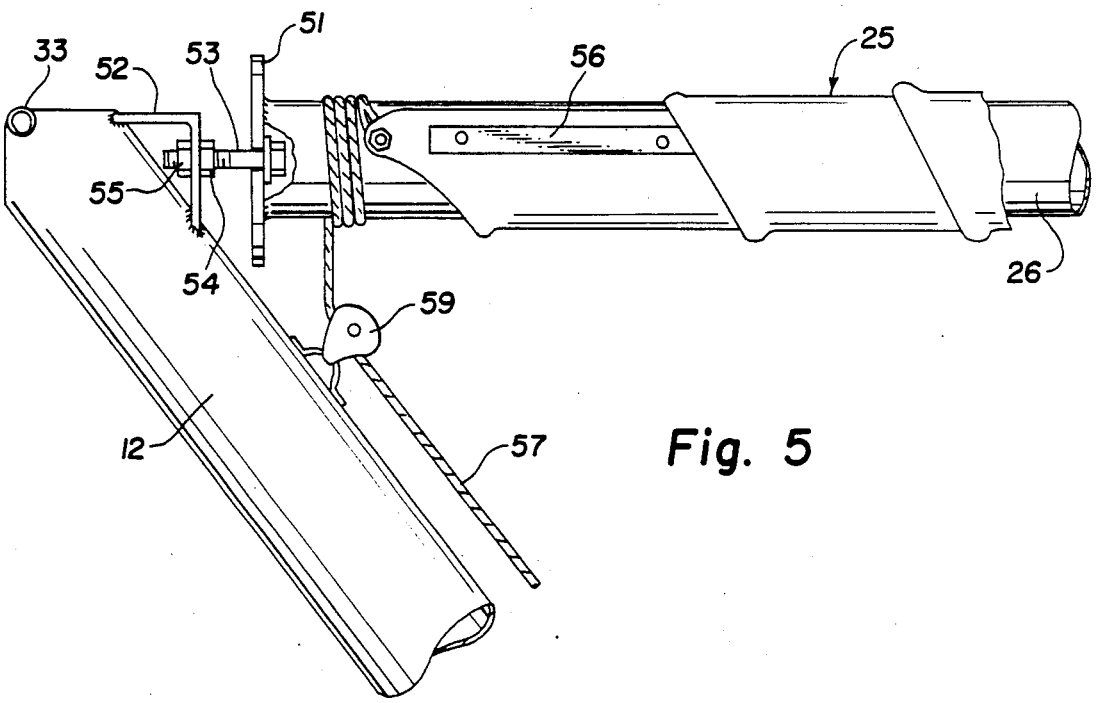
FIG. 5 is a fragmentary detail view of the mounting of one end of the roller boom on a frame spar.

The configuration and mounting of the sail roller boom 26 is best seen in FIG. 5. The roller boom may be fabricated from aluminum tubing, for example, having end plates 51 integrally secured at each end and having central apertures which function as bearing apertures. Brackets 52 are rigidly mounted at the distal ends of the left lee spar and right lee spar. The shanks of headed bolts 53 extend through the end plate apertures and through apertures in the brackets 52;; and these bolts are locked in place by nuts 54 and 55. The bolt shanks then define journals for the bearing apertures of the end plates 51, defining the rotational axis for the roller boom; and these headed bolts coacting with the end plates also function as thrust bearings to take up any forces tending to separate the left and right lee spars. The roller boom then functions as a tension member between the spars, coacting with the horizontal stays 14 between these spars and the windward spar to maintain the structural integrity of the boat frame. FIG. 5 also illustrates how the base of the sail 25 is secured to the roller boom by means of a strap 56 bolted to the boom and disposed adjacent to the base and boltrope of the sail.

Figure 9:
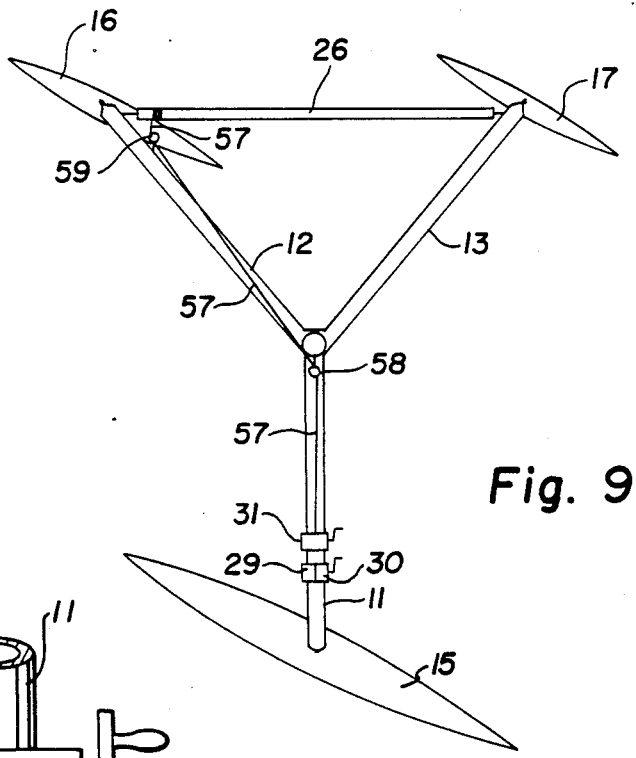
FIG. 9 is a diagrammatic view illustrating the control of the said.

To effect the reefing of the sail, a reefing line as best seen in FIG. 9 extends from the reefing winch 31 through a pulley 58 mounted adjacent to the juncture of the boat frame, through a pulley 59 mounted adjacent to the distal end of the left lee spar 13 and is wound around the roller boom 26 adjacent to its left end, with the distal end of the line secured to the roller boom. When the sail is fully reefed, only a few turns of the reefing line are wound around the boom; and when the sail is raised by means of the halyard 28 and halyard winch 29, additional turns of the reefing line are wound about the roller boom.

Preferably the halyard winch is provided with some form of adjustable friction clutch 30 to maintain a preselected tension on the halyard. One function of this clutch is to provide a safety feature, enabling the pilot to set a maximum tension on the halyard and thereby limit forces on other parts of the boat resulting from wind gusts for example; and this clutch may also assist in the reefing of the sail, maintaining some tension on the halyard to assure smooth take up of the sail onto the roller boom.

Figure 10:
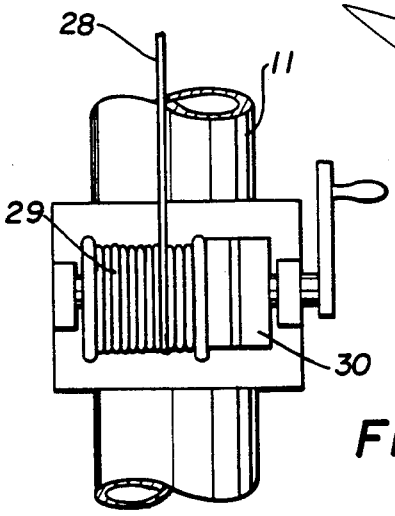
FIG. 10 is a fragmentary view illustrating the halyard winch and associated friction clutch of FIG. 9.

FIG. 10 illustrates fragmentarily the halyard winch 29 and associated friction clutch 30 which are indicated in FIG. 9.

It will be seen that, with this arrangement, the sail is reefed by taking up the reefing line by means of the reefing winch which effects rotation of the roller boom to reef the sail; and the clutch of the halyard winch should be adjusted to maintain some tension on the halyard winch should be adjusted to maintain some tension on the halyward and allow smooth reefing of the sail onto the roller boom. It will also be seen that, with this arrangement, the sail may be partially reefed at any time that the wind becomes too strong to utilize the full sail area or, to put it another way, any desired amount of sail may be presented to the wind at the option of the boat pilot.

Operation

The control of the sailboat from the standpoint of setting different courses relative to the wind direction is much more complicated than that of a conventional sailboat. For putting the sailboat in motion, all three hulls are aligned parallel to each other and at a desired angle relative to the sail roller boom 26. If the lee hulls are aligned parallel with the roller boom, the motion of the sailboat will stop.

For a slight change of direction once a course is established, either the leading lee hull or the trailing lee hull may be turned relative to the other hulls; and this will cause the entire sailboat to change direction. When the new heating is achieved, the control hull is then returned to parallel alignment with the other hulls. To make a more significant turn from a tack to a reach for example, the two lee hulls may be turned simultaneously a desired number of degrees by means of the respective cranks 46 and this will produce an abrupt change in boat direction. Depending on the keel action of the windward hull, the windward hull should be aligned parallel with the lee hulls as soon as possible. This will produce an abrupt change in the boat's direction without change in the angle of the sail boom relative to the wind. It may then be desired to change that angle of the sail boom, to better utilize the wind for speed, and this is accomplished by changing the direction of the lee hulls relative to the boom one by one until the desired boom angle is achieved and again aligning the windward hull with the lee hulls.

For coming about, from a port tack to a starboard tack for example, it is necessary to stop the motion of the sailboat and proceed in a different direction in which the hulls are moving in the water in the opposite direction from the previous tack. That is, what was the leading ends of the hulls would now become the trailing ends and vice versa. To accomplish this, the two lee hulls may first be aligned parallel with the boom. This will cause the motion of the boat to stop. When the formerly leading hull is now turned to the opposite direction relative to the boom (the hull position for the new tack), the sailboat will turn through the wind toward the position for the new tack. During this turn, the windward hull will be moving very slowly and should be turned parallel with the formerly leading hull. When the sailboat turn or swing approaches the position for the new tack, the now leading lee hull should be turned parallel with the other hulls and the boat attitude or position relative to the wind is now established on the new tack.

What has been described is a multiple-hull sailboat which is light in weight, which can carry a sail of much larger area in relation to its weight thank known multiple-hull sailboats, and which therefore is a faster boat than such known sailboats.

A feature of the sailboat according to the invention is that one of the three hulls is always the windward hull, and the other two hulls are lee hulls, that the sail is supported on the boat in a plane defined generally by the two lee hulls and the masthead which is disposed generally above the windward hull so that the sail is inclined upwardly from the lee hulls toward the windward hull, with the result that the sailboat does not heel and the possibility of the boat capsizing is almost nil.

A further feature of the invention is that the sail is mounted on a roller boom supported between the two lee hulls, whereby the sail may be reefed by taking up the sail on the roller boom and is raised by means of a halyward reeved over the masthead. A related feature of the invention is that the roller boom may be operated by a reefing winch, and the halyard may be taken up by means of a halyard winch having an adjustable clutch control to preset the maximum tension on the halyard.

Another feature of the invention is that the three hulls are mounted to be steered independently relative to the boat frame; and that controls are provided for the separate steering of each of the three boat hulls to provide for the desired maneuvering and control of the sailboat.

A further feature of the invention is that the three hulls have a high length-to-beam ratio, are symmetrical about a central axis and designed for movement through the water in opposite directions, have deep V bottoms for movement through the water with minimum resistance, and are mounted relative to the boat frame for movement about horizontal transverse axes to allow independent pitching of the hulls relative to the frame.

Still another feature of the invention is that, because of the roller boom reefing of the sail, the amount of sail area presented to the wind may be selected by the boat pilot and may be changed very quickly by the boat pilot to accommodate varying wind conditions.

Another feature of the invention is the frame structure which consists of three spars joined together by a coupler which defines a pivot mounting for each of the three spars, with the same coupler defining a pivot mounting for the mast relative to the frame. The coupler defines pivot axes for each of the three spars and the mast, which axes are related that all four of these members may be folded together in parallel relation when the boat is disassembled. This enables the members to be collapsed together without disengagement from the coupler, to form a compact assembly of these members for either storage or overland transport. In the setting up of the sailboat frame and mast to the working relationship, the members are readily unfolded to the desired relationship. The two lee spars may first be unfolded for example so that the roller boom may be connected between them. The relationship of the three frame spars is then established by connecting the horzontal stays. After the frame is mounted on the respective three hulls, the mast may be raised to the desired orientation relative to the frame; and this orientation is fixed by the attachment of the forestays and back stay. An ancillary advantage of the pivoted mast arrangement is that the angle of the mast may be readily changed relative to the frame, in order to change the angle of the sail relative to the water surface.

While the preferred embodiment of the invention has been illustrated and described, it will be understood by those skilled in the art that changes and modifications may be resorted to without departing from the spirit and scope of the invention.

What is claimed is:

1. A sailboat comprising a frame defining three triangularly spaced support points for support by three respective buoyant hulls, including a windward support point and two lee support points;

three independent buoyant hulls coupled to said three frame support points, to support said frame; said three hulls consisting of a windward hull coupled to said windward support point and two lee hulls coupled to said lee support points;

coupling means including vertical pivot axes for securing said frame to said three hulls independently, to enable independent steering of said hulls relative to said frame;

a mast supported on said frame, having a masthead disposed equidistant from said lee support points and toward said windward support point;

means for supporting a sail generally in a plane defined by said lee support points and said masthead, whereby said sail is inclined upwardly from said lee hulls toward said windward hull;

means for steering each of said three hulls independently of each other through limited arcs relative to said frame to enable the maneuvering of said boat; and each of said buoyant hulls being elongated and configured to move efficiently through the water in either of two opposite directions to enable the selective positioning of one or the other of said lee hulls as the lead hull, with said hulls moving through the water in corresponding opposite directions.

2. A sailboat as set forth in claim 1 including each of said hulls having a length at least six times its width, having a deep "V" bottom profile, and being symmetrical about a central transverse plane.

3. A sailabot as set forth in claim 1 including said frame comprising a tripod frame consisting of a windward spar, a right lee spar, and a left lee spar joined together, at the center; said frame support points being disposed at the respective distal ends of said spars.

4. A sailboat as set forth in claim 3 including said mast extending upward from the center of said tripod frame.

5. A sailboat as set forth in claim 3 including said frame spars being joined by a coupler having means defining a first pair of parallel pivot axes for said lee spars, and means defining a second pair of parallel pivot axes for said windward spar and said mast; said first and second pairs of pivot axes being disposed in respective parallel planes.

6. A sailboat as set forth in claim 1 including said means for coupling said frame to said hulls including horizontal axes transverse to the length of said hulls for enabling independent pitching of said hulls relative to said frame.

7. A sailboat as set forth in claim 1 including said hulls being fabricated from thin sheet material without internal bulkheads, and formed as closed sealed bodies; the shape of said hulls being maintained by internal air pressure.

8. A sailboat as set forth in claim 7 including said hulls being configured with gentle convex compound curves, maintained by said internal air pressure.

9. A sailboat as set forth in claim 1 including the base of said sail being supported generally parallel with a line extending between said lee hull support points.

10. A sailboat as set forth in claim 1 including said sail being inclined at an angle, relative to the water surface, that the resultant sail force vector passes through or below said windward hull.

11. A sailboat as set forth in claim 1 including a halyard reeved over said masthead for supporting the upper end of said sail; a winch for taking in said halyard; and friction clutch associated with said winch to limit the maximum tension on said halyard.

12. A sailboat as set forth in claim 1 including a sail mounted on said sailboat, having an elongated base secured along a line adjacent to and parallel to a line between said two lee support points;

means mounting said sail in a manner to enable letting out or taking in a portion only of said sail, to present a selected sail area to the wind.

13. A sailboat as set forth in claim 12 including said sail being triangular, whereby a triangular sail area of selected size is presented to the wind.

14. A sailboat comprising a frame defining three triangularly spaced support points for support by three respective buoyant hulls, including a windward support point and two lee support points;

three independent buoyant hulls coupled to said three frame support points, to support said frame; said three hulls consisting of a windward hull coupled to said windward support point and two lee hulls coupled to said lee support points;

each of said buoyant hulls being elongated and configured to move through the water in either of two opposite directions;

coupling means including vertical pivot axes for securing said frame to said three hulls independently, to enable independent steering of said hulls relative to said frame;

a mast supported on said frame, having a masthead disposed equidistant from said lee support points and toward said windward support point;

means for supporting a said generally in a plane defined by said lee support points and said masthead, whereby said sail is inclined upwardly from said lee hulls toward said windward hull;

means for steering each of said three hulls independently relative to said frame;

a roller boom rotatably mounted on said frame; the ends of said roller boom being coupled to said frame adjacent to the two lee support points;

the base of the sail for said sailboat being connected to said roller boom for reefing thereon.

15. A sailboat as set forth in claim 14 including a triangular sail mounted on said sailboat, having an elongated base edge attached to said roller boom.

16. A sailboat as set forth in claim 14 including a halyard reeved over the top of said mast for supporting the upper end of said sail; a winch for taking in said halyard; a friction clutch associated with said winch to limit the maximum tension on said halyard.

17. A sailboat as set forth in claim 16 including said halyward winch being mounted on said frame adjacent to said windward support point.

18. A sailboat as set forth in claim 14 including a reefing winch mounted on said frame adjacent to said windward support point for effecting rotation of said roller boom to reef said sail.

19. A sailboat as set forth in claim 14 including said roller boom being coupled to said frame in a manner to function as a tension member between said two lee support points.

20. A sailboat comprising a generally tripod frame supported on the water by three independently buoyant hulls; said tripod frame comprising three spars extending outwardly from a center juncture point, and defining hull support points at the respective distal ends of said spars;

three independently buoyant hulls coupled to said three frame support points to support said frame; each of said buoyant hulls being horizontally elongated for movement through the water in the direction of its longitudinal axis;

coupling means for coupling each of said buoyant hulls to a respective frame support point, including means providing a vertical steering axis and means providing a transverse pitch axis to allow each freedom to pitch relative to said frame;

said frame defining a windward support point and two lee support points;

a mast mounted on said frame having its masthead disposed equidistant from said lee support points and generally above said windward support point;

means for attaching a sail to said sailboat disposed generally in a plane defined by said two lee support points and said masthead, whereby said sail is inclined upwardly toward said windward support point;

a generally horizontal roller boom mounted on said frame and extending generally between said lee support points;

a sail having its base attached to said roller boom, whereby said sail may be reefed by rolling on the boom to present zero percent to one hundred percent of the sail area to the wind.

21. A sailboat as set forth in claim 20 including the upper end of said sail being secured by a halyard reeved over said masthead;

a halyard winch mounted on said frame for the reeling of said halyard; said halyard winch having an adjustable friction clutch to limit the maximum tensil force that may be imposed on said halyard by said sail.

22. A sailboat as set forth in claim 20 including a coupler defining said junction point; said coupler having means defining a pair of parallel pivot axes for two of said spars, and a third pivot axis for the other of said spars disposed in a plane parallel to the plane of said pair of pivot axes.

23. A sailboat as set forth in claim 20 including said roller boom being coupled to said frame in a manner to function as a tension member between said two lee support points.

* * * * *